US005905462A

United States Patent [19]

Hampel et al.

[11] Patent Number: 5,905,462

[45] Date of Patent: May 18, 1999

[54] STEERABLE PHASED-ARRAY ANTENNA WITH SERIES FEED NETWORK

[75] Inventors: Karl Georg Hampel, New York, N.Y.; Gary M. Hojell, Kinnelon, N.J.

[73] Assignee: Lucent Technologies, Inc., Murray Hill, N.J.

[21] Appl. No.: 09/040,780

[22] Filed: Mar. 18, 1998

[51] Int. Cl.[6] ..... H01Q 3/22; H01Q 3/24; H01Q 3/26

[52] U.S. Cl. ..... 342/372; 342/368; 333/159

[58] Field of Search ..... 342/372, 368; 333/159

[56] References Cited

U.S. PATENT DOCUMENTS 5,504,466 4/1996 Chan-Son-Lint et al. ..... 333/159
5,798,675 8/1998 Drach ..... 333/161

*Primary Examiner*—Theodore M. Blum

[57] ABSTRACT

A phased-array antenna having either a corporate or series feed network advantageously includes a phase-shifter array comprised of mechanical phase shifters for beam steering. In some embodiments, the phase-shifter array includes a plurality of phase-shifting slabs each of which includes a phase-shifting member advantageously comprised of a dielectric material. When placed in electromagnetic fields generated by signals propagating through different regions of a transmission line, the phase-shifting members affect the phase of such signals. In some embodiments, the plurality of phase-shifting slabs are mechanically linked by a rigid linkage that is driven by a single driving mechanism. In those embodiments, the phase-shifting slabs and incorporated phase-shifting members in the phase-shifter array are moved in unison, relative to the transmission line, causing a shift in the relative phases of a multiplicity of signals, thereby steering the antenna beam. Each phase-shifting slab in the phase-shifter array also advantageously incorporates at least one impedance-matching member that decreases or eliminates a step change in impedance between air-suspended and dielectric-loaded regions of a transmission line over the full phase-shifting range of the phase-shifting members. Due the reduced incidence of impedance mismatch, phase shifters used in conjunction with the present antenna may be comprised of materials having a relatively high dielectric constant. Using relatively high-dielectric-constant materials results in relatively small phase shifters for a given phase shifting range, or a relatively large phase-shifting range for a given phase shifter size. The phase-shifter array is advantageously readily compatible with flat-panel antenna arrays with little or no modification required to the feed network due to the phase shifter array.

25 Claims, 8 Drawing Sheets

STEERABLE PHASED-ARRAY ANTENNA WITH SERIES FEED NETWORK

STATEMENT OF RELATED CASES

The present case is related to applicants' copending U.S. patent applications, Ser. No. 09/040,850 filed Mar. 18, 1998 entitled, "Article Comprising a Phase Shifter," and Ser. No. 09/040,848 filed Mar. 18, 1998 entitled "Steerable Phased-Array Antenna with Series Feed Network," both of which are assigned to the present assignee and incorporated by reference herein.

FIELD OF THE INVENTION

The present invention relates to telecommunications. More particularly, the present invention relates to a steerable phased-array antenna.

BACKGROUND OF THE INVENTION

There has been explosive growth in the area of wireless communications. A few years ago, the sight of a person speaking into a cellular phone was a curiosity; now it is commonplace. Communication via cellular phones is supported by wireless telecommunications systems. Such systems service a particular geographic area that is partitioned into a number of spatially-distinct areas called "cells." Each cell usually has an irregular shape (though idealized as a hexagon) that depends on terrain topography. Typically, each cell contains a base station, which includes, among other equipment, radios and antennas that the base station uses to communicate with the wireless terminals (e.g., cellular phones) in that cell.

The antenna used for transmitting signals from a base station is typically a linear phased-array antenna. A phased-array antenna is a directive antenna having several individual, suitably-spaced radiating antennas, or elements. The response of each radiating element is a function of the specific phase and amplitude of a signal applied to the element. The phased array generates a radiation pattern ("beam") characterized by a main lobe and side lobes that is determined by the collective action of all the radiating elements in the array.

It may be desirable, at times, to adjust the geographic coverage of a particular base station. This can be accomplished changing the azimuth ("beam steering") or elevation ("beam tilting") or both (henceforth "beam steering"), of the beam generated by a base station's transmit antenna.

The beam generated by a linear phased-array antenna can be tilted by mechanically rotating the entire antenna array, or by employing a progressive element-to-element phase shift. The two different approaches are not equivalent in terms of their effect on an antenna's radiation pattern. Down tilting via progressive phase shift results in a decrease in peak gain efficiency while the azimuth radiation pattern stays the same. On the other hand, mechanical down tilting can significantly distort the azimuth radiation pattern when projected on the ground-level coverage zone within a cell. Moreover, while progressive phase shifting provides the ability to beam "shape," mechanical down tilting does not. For the foregoing reasons, it is generally preferable to use phase shifting rather than mechanical down tilting.

Progressive phase shift can be accomplished using phase shifters. Most conventional phase shifters suffer from various drawbacks that makes implementation into phase arrays problematic. For example, some conventional phase shifters, such as switchable delay lines and ferrites, are large (and expensive). Integrating such large-sized phase shifters into phased-array antennas often requires modification of the feed network. Other conventional phase shifters, such as solid-state hybrid-coupled-diode phase shifters and thin-film ferrites, disadvantageously exhibit substantial nonlinearity. Moreover, solid-state hybrid-coupled-diode phase shifters have high insertion loss requiring that amplifiers be used at the top of a base station tower to increase signal levels. At the high power levels required for transmission, such amplifiers are heavy, big and expensive. While at the lower power levels characterizing "receive" operation, such amplifiers are considerably smaller and less expensive, it is still generally undesirable to have such active RF electronics at the top of a tower. Still other conventional phase shifters, such as "sliding contact shifters," suffer from corrosion and electrical contact problems over time. In one implementation of a sliding-contact phase shifter, coaxial lines "telescope" into or out of one another such that the line length of the phase shifter, and hence the phase imparted thereby, is changed.

Thus, there is a need for a steerable phased-array antenna having a phase-shifter array that avoids the drawbacks of the prior art and is readily implemented into antenna feed networks without substantial modifications thereto due to the size, weight, etc., of the phase-shifting array.

SUMMARY OF THE INVENTION

A phased-array antenna in accordance with illustrative embodiments of the present invention advantageously includes a plurality of radiating elements and a phase-shifter array comprised of "mechanical" phase shifters for beam steering. The phase-shifter array is advantageously readily compatible with flat-panel antenna arrays.

In some embodiments, the phase-shifter array includes a multiplicity of phase-shifting slabs each of which includes a phase-shifting member, advantageously comprised of a dielectric material. When placed in electromagnetic fields generated by signals propagating through different regions of a transmission line (or through different transmission lines), which, as used herein, is understood to be a (quasi) transverse electromagnetic (TEM) transmission line (e.g., micro strip line and strip line), the phase-shifting members affect the phase of such signals. As the "dielectric loading" of the transmission line changes at the various regions, such as by changing the amount of dielectric material that interacts with the local electromagnetic fields, the relative phase of the signals is shifted. In some embodiments, the multiplicity of phase-shifting slabs are mechanically linked by a rigid linkage that is driven by a single driving mechanism. In those embodiments, the phase-shifting slabs and incorporated phase-shifting members in a phase-shifter array are moved in unison, relative to the transmission line, causing a shift in the relative phases of a multiplicity of signals, thereby steering the antenna beam.

As used herein, the phrase "phase-shifting range" refers to a range of relative phase-shift that can be imparted by a phase shifter (e.g., 0 to $2\phi$, $-1\phi$ to $2\phi$, etc.). The range is defined by the relative phase shift imparted by the phase-shifting member at a first and a second position. In the first position, the phase-shifting member is not present between the active line and the ground plane (or, more properly, the phase-shifting member does not interact with an electromagnetic field generated between the active line and the ground plane due the presence, in the active line, of a signal). In the second position, the phase-shifting member is positioned between the active line and the ground such that it provides the maximum dielectric loading that it is capable of providing to the transmission line.

Each phase-shifting slab in the phase-shifter array also advantageously incorporates at least one impedance-matching member that decreases or eliminates impedance differences "impedance mismatch" between air-suspended (i.e., air between the active line and the ground plane) and dielectrically-loaded (i. e., dielectric material between the active line and the ground plane) regions of a transmission line.

As is known in the art, impedance refers, in the present context, to the ratio of the time-averaged value of voltage and current in a given section of the transmission line. This ratio, and thus the impedance of each line section, depends on the geometrical properties of the transmission line, such as, for example, active line width, the spacing between the active line and the ground, and the dielectric properties of the materials employed. If two lines section having different impedance are interconnected, the difference in impedances ("impedance step" or "impedance mismatch") causes a partial reflection of a signal traveling through such line sections. "Impedance matching" is a process for reducing or eliminating such partial signal reflections by disposing a "matching circuit" between the interconnected line segments. As such, impedance matching establishes a condition for maximum power transfer at such junctions.

In accordance with the present teachings, the impedance-matching members provide impedance matching over the full phase-shifting range of the phase-shifting members. To the extent that the prior art practices impedance matching by including "impedance circuits" in the active line, such circuits typically provide impedance matching at only one position of the phase shifters. Using the present full-range impedance-matching members facilitates using a "series" feed network (in which impedance mismatches are additive) with the present phased-array antenna. Moreover, since phased-array antennas in accordance with the illustrative embodiments exhibit much less impedance mismatch than conventional phased arrays using conventional impedance-matching circuits, the present phase shifters may be comprised of materials having a relatively high dielectric constant. Using relatively high-dielectric-constant materials results in relatively small phase shifters, for a given phase shifting range. Alternatively, for a given phase shifter size, using relatively high-dielectric-constant materials results in a relatively large phase-shifting range. Phase shifters having a relatively large shifting range are advantageously used in conjunction with phased-arrays having "corporate" feed networks.

The present phased-array antennas provide numerous advantages over conventional phased-array antennas that use conventional phase-shifting arrays. One advantage is, due to the small size of phase-shifter arrays in accordance with the present teachings, such phase-shifter arrays can be readily implemented into substantially any flat-panel antenna array such that feed layout is substantially unaffected (e.g., no increase in required layout area). Such phase-shifter arrays therefore have a substantially inconsequential impact on the size, weight and cost of a phased-array antenna. This is not true of ferrite phase shifters, for example, which are large, heavy and expensive, or of switchable delay lines, which are large and expensive. Moreover, phase-shifting arrays in accordance with the present teachings advantageously exhibit substantially linear phase response and substantially no power limitations or insertion loss, unlike solid-state hybrid-coupled-diode phase shifters, for example, which exhibit high insertion loss and nonlinearity.

Since the present phased-array antennas are advantageously implemented with (quasi) TEM transmission lines, wherein the dielectric slabs comprising the phase-shifter arrays are inserted into the relatively homogeneous field between an active line and the ground plane, a high phase shift per transmission-line length results (relative to insertion into the "fringe" field located above the active line) and the phase-shifter array is relatively insensitive to fabrication variations and slab positioning. By advantageously driving the phase-shifter array with a single drive mechanism, phased-array cost, design and calibration efforts are reduced relative to shifter arrays driven by multiple drive units. Furthermore, using a single drive mechanism facilitates using remote beam-steering capabilities.

Further features and advantages of the present phased-array antennas will become more apparent from the following detailed description of specific embodiments thereof when read in conjunction with the accompany drawings, which are listed below.

DETAILED DESCRIPTION

The present phased-array antennas are useful for wireless telecommunications, among other applications. As will be appreciated by those skilled in the art, the relevant operating frequencies of such wireless telecommunications applications are typically in the range of about 0.5 to 5 gigahertz (GHz). As such, quasi-TEM transmission lines, such as micro strip (one ground) or strip lines (two grounds) are usually employed. Moreover, as previously described, the relatively homogeneous electromagnetic field that is present between an active line and ground plane of a (quasi)-TEM transmission line is used to great advantage by the present phase shifters.

To facilitate description of phased-array antennas in accordance with illustrative embodiments of the present invention, certain aspects of conventional phased-array antennas are first described below.

To position the main lobe of the radiation pattern generated by a phased-array antenna at an angle$\theta_o$, (relative to a "bore-sight" beam wherein the main lobe is perpendicular to the radiating antenna elements), phase shift between adjacent radiating elements of the antenna array must be:

$$\phi=2\pi(d/\lambda)\sin\theta_o \quad [1]$$

where: d is the spacing between radiating elements; and $\lambda$ is the wavelength of the transmitted signal.

The required phase relationships between the radiating elements is obtainable using either a "series" or a "corporate" feed network.

Corporate feed networks suffer from a disadvantage that the tuning range required of each successive phase shifter is additive; the nth phase shifter must have a tuning range of $(n-1)\Delta\phi$. As such, antennas using such feed networks are usually limited to a relative small number of radiating antenna elements. Series feed networks suffer from a disadvantage that any impedance mismatch occurring in the network (e.g., due to the phase shifters) interferes with successive elements, resulting in undesirable signal reflections. Advantageously, impedance mismatch problems are not additive in phased arrays having corporate feed networks, and phase shifters can be implemented in a series feed network such that they are identical, thereby simplifying fabrication. Thus, each of such networks has certain advantages and disadvantages that dictate use of one or the other of such networks for a particular application. As described later in this specification, the present phase-shifting arrays are readily implemented into either type of feed network to provide a corporate or series fed phased-array in accordance with the illustrative embodiments of the present invention.

Figure 1:
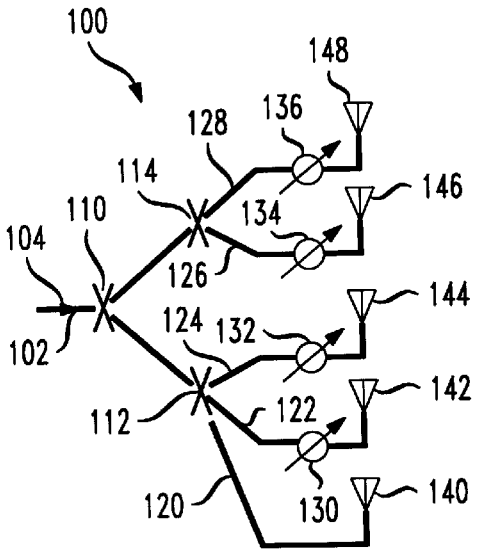
FIG. 1 PRIOR ART
FIG. 1 depicts a simplified schematic of a conventional phased-array antenna having a corporate feed network and phase shifters.

FIG. 1 shows a schematic of a conventional phased-array antenna 100 having an asymmetric corporate feed network. Signal 104 traveling along transmission line 102 is split, by power splitters 110–114, and directed via transmission lines 120–128 to radiating elements 140–148. The path lengths from power splitter 110 to each radiating element are equal so that no phase shift is introduced by the feed network itself. This condition is frequency independent. Phase shifters 130–136 are operable to introduce phase shift into the signals traveling along respective transmission lines 120–128 for beam steering, as desired.

In phased-array antennas having a corporate feed network, such as phased array 100, phase shifters must be implemented separately in each branch (i.e., lines 120–128) before each radiating element 140–148. As such, the total tuning or phase-shifting range per phase shifter must increase progressively from element-to-element. Taking antenna element 140 as a reference, the phase shift required in phase shifter 130 for antenna element 142 is $1\Delta\phi$. The phase shift required in phase shifter 132 is $2\Delta\phi$, in phase shifter 134 is $3\Delta\phi$,and in phase shifter 136 is $4\Delta\phi$. In general, the final phase shifter in a phased array using a corporate feed network and having n radiating elements requires a tuning range of $(n-1)\Delta\phi$. A corporate-fed phased array configured in the manner of FIG. 1 is thus restricted in the total number of array elements by the progressive increase required in phase shifter tuning range.

Figure 2:
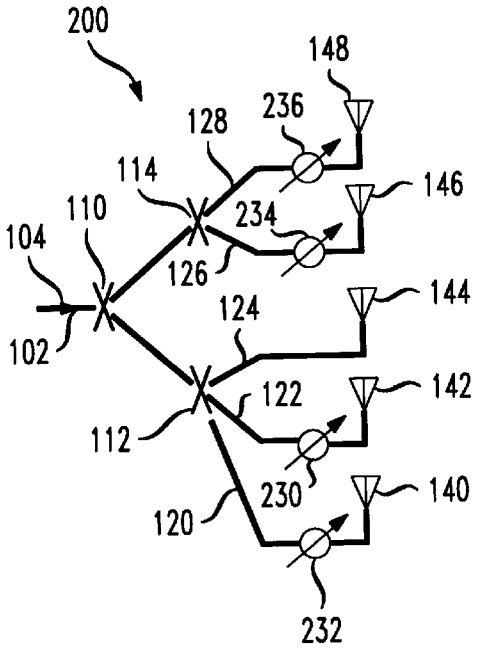
FIG. 2 PRIOR ART
FIG. 2 depicts a simplified schematic of a conventional phased-array antenna having a symmetrical corporate feed network and phase shifters.

It is known in the art that the maximum tuning range requirement $(n-1)\Delta\phi$ can be halved in a corporate-fed phased array 200 that uses a symmetrical feed network, such as is illustrated in FIG. 2. In the phased array 200, antenna element 144 is taken as a reference. Each successive antenna element in the lower branch (i.e., 142, 140) is diminished in phase by $\Delta\phi$ such that phase shifter 230 requires a tuning range of $-1\Delta\phi$ and phase shifter 232 requires a tuning range of $-2\Delta\phi$. Each successive antenna element in the upper branch is enhanced in phase by $\Delta\phi$ such that phase shifter 234 requires a tuning range of $1\Delta\phi$ and phase shifter 236 requires a tuning range of $2\Delta\phi$. It will be appreciated that the phase of the antenna elements in the upper branch could alternatively be diminished while those in the lower branch are enhanced.

The tuning range requirement for phase shifter 236, at $2\Delta\phi$, is thus one half of that required for phase shifter 136 of phased array 100 (FIG. 1). In addition to decreasing the maximum tuning range requirement, the symmetrical arrangement shown in FIG. 2 provides the ability to vary gain and beam width if the sub-arrays are separately driven. The gain variation is obtained by steering the sub-arrays in opposite directions, which widens the beam and reduces the gain.

Figure 3:
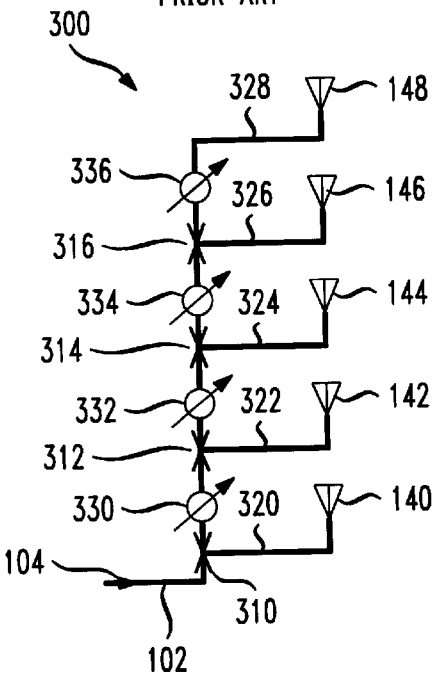
FIG. 3 PRIOR ART
FIG. 3 depicts a simplified schematic of a conventional phased-array antenna having a series feed network and phase shifters.

FIG. 3 shows a schematic of a conventional phased-array antenna 300 having an asymmetric series feed network. Signal 104 traveling along transmission line 102 is split, successively, by power splitters 310–316, and directed via transmission lines 320–328 to radiating elements 140–148. Transmission lines 320–328 are of identical length so that no phase shift is introduced by the feed network itself Phase shifters 330–336 are operable to introduce phase shift into the signals traveling along transmission line 102.

Unlike a corporate feed arrangement wherein phase shifters are disposed in each individual branch leading to a radiating element, phase shifters 320–328 are disposed in the feed line (i.e., line 102) to each individual branch line (i.e., line 320–328). As such, the signal entering each successive phase shifter has shifted in the preceding phase shifters. Since the phase differential required for each adjacent radiating element is $\Delta\phi$, the tuning range for each phase shifter 320–328 is the same and has a maximum value of only $1\Delta\phi$.

Thus, unlike a phased-array antenna utilizing a corporate feed network, there is no limitation on the number of radiating elements arising from phase shifter limitations. Phased-array antennas using series feed networks tend, however, to be significantly more sensitive to design, material and manufacturing tolerances than corporate feed networks, since such tolerances are additive.

Figure 4:
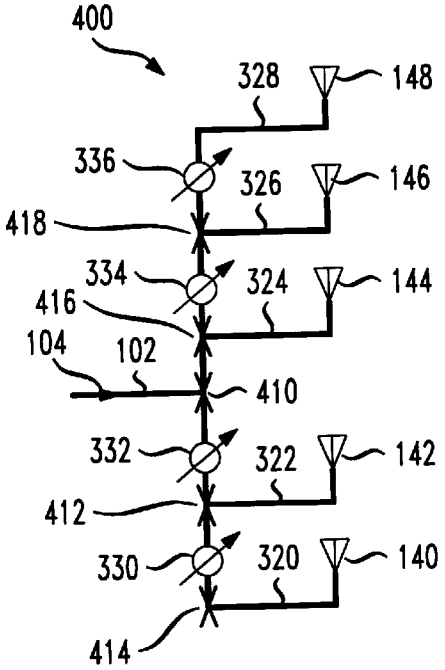
FIG. 4 PRIOR ART
FIG. 4 depicts a simplified schematic of a conventional phased-array antenna having a symmetrical series feed network and phase shifters.

Like the corporate feed network, a series feed network can be symmetrically implemented. A phased array using a symmetrical series-feed network, like phased array 400 depicted in FIG. 4, has enhanced bandwidth since the upper branch's beam "squints" in the opposite direction of the lower branch's beam, thereby maintaining peak composite beam location. Furthermore, it is less sensitive to design, material and manufacturing tolerances than an asymmetric network.

Having provided the foregoing background concerning conventional phased arrays, feed networks, and the integration of phase shifters therein, illustrative embodiments of the present invention are now described.

In accordance with illustrative embodiments of the present invention, phased array antennas utilizing either asymmetrical or symmetrical corporate or series feed networks advantageously incorporate phase shifters described in applicants' copending U.S. patent application Ser. No. 09/040,850 filed Mar. 18, 1998 entitled, "Article Comprising a Phase Shifter."

Such phase shifters advantageously comprise a phase-shifting slab having a phase-shifting member. In some embodiments, the phase-shifting member is configured to provide a continuous, linear change in width, while maintaining a uniform dielectric constant and thickness throughout. Due to such a linear change in width, the amount of dielectric material positioned between the active line and the ground varies linearly as the phase-shifting slab is moved therebetween. Such phase-shifting members therefore advantageously produce a linear phase response.

The effective dielectric constant of the transmission line is a function of the dielectric constant of a material, and the amount of such material, disposed between the active line and the ground plane. In accordance with the present invention, the line impedance is changed, and impedance mismatch is reduced or avoided, by providing at least one impedance-matching member that is insertable between the active line and the ground plane. When so inserted, the impedance-matching member provides a dielectric loading suitable for reducing or eliminating potential impedance mismatch, such as between air-suspended and dielectric-loaded regions of the transmission line. The impedance-matching member is advantageously incorporated into a phase-shifting slab of the present phase shifters.

The impedance-matching member eliminates impedance change at one specific frequency. As signal frequency deviates from the one frequency, the impedance step between the dielectric- and air-suspended regions begins to increase. Even in such cases, as long as the impedance-matching member's design bandwidth is not exceeded, the incidence and severity of signal reflections that occur due to the increasing impedance step change are reduced relative to those experienced with conventional phase shifters not possessing an impedance matching member.

In some embodiments of phase shifters in accordance with the present invention, the impedance-matching member is advantageously configured such that the impedance change is eliminated, or, depending upon signal frequency, substantially reduced, over the full tuning or phase-shifting range. In those embodiments in which full-range impedance matching is provided, the present phase shifters may advantageously be comprised of high-dielectric-constant materials, and therefore smaller than most conventional phase shifters.

The dielectric constant of the phase-shifting members and impedance-matching members for use in the present phase shifters will suitably be in a range of about 2 to 15. while materials with a lower or higher dielectric constant can be used, an increase in size of the phase-shifting members (with decreasing dielectric constant), and an increase in sensitivity to mechanical tolerances and slab positioning (with increasing dielectric constant), generally makes the use of such materials less desirable. Materials suitable for use as the phase-shifting and impedance-matching members are well known to those skilled in the art.

Figure 5A:
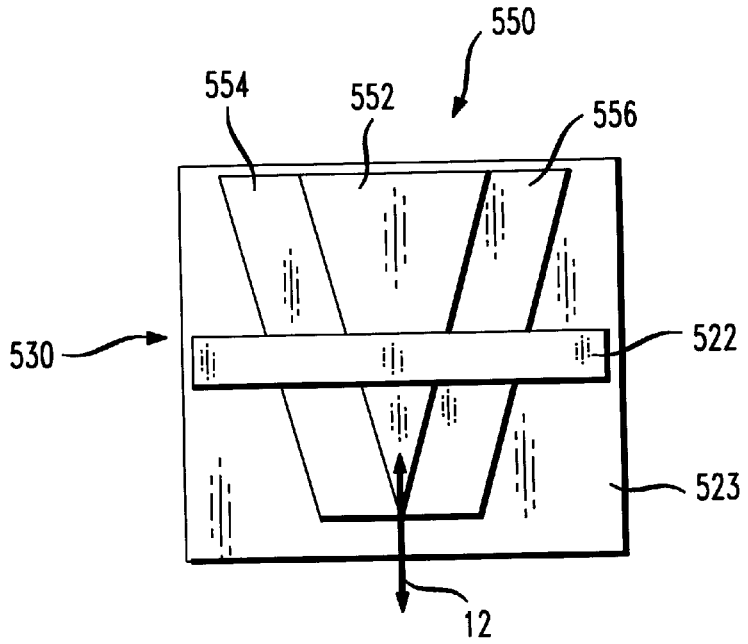
FIGS. 5*a* and 5*b* show top and side-cross sectional views of an illustrative phase shifter for use in conjunction with illustrative embodiments of the present invention.
Figure 5B:
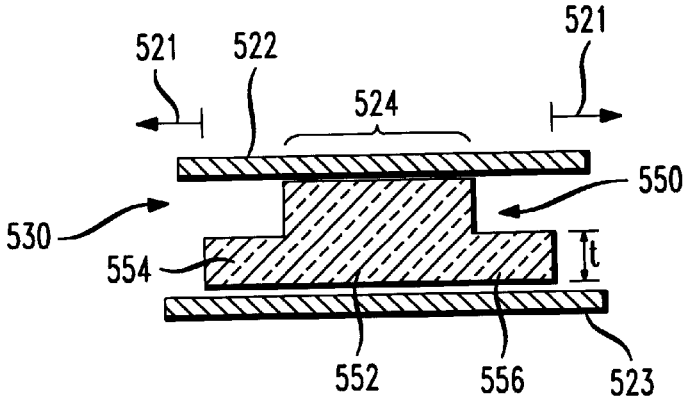

FIGS. 5*a* and 5*b* show top and side-cross sectional views of an illustrative phase shifter 530 in accordance with an illustrative embodiment of the present invention. Phase shifter 530 comprises phase-shifting slab 550 having phase-shifting member 552 and impedance-matching members 554 and 556 all comprised of dielectric material. The impedance-matching members are operable to provide impedance matching over the full phase-shifting range of the phase-shifting member.

Phase shifter 530 is shown "inserted" in a transmission line comprising active line 522 and ground plane 523. The phase-shifting member is thus within an electromagnetic field generated by a signal propagating in active line 522. Since phase-shifting member 552 varies in width along direction vector 12, as phase-shifting slab 550 moves in a direction indicated by direction vector 12, an amount of dielectric material present within the electromagnetic field of the signal varies. Such variation causes a change in the effective dielectric constant of the transmission line, and hence the propagation velocity of the signal. Thus, movement of phase-shifting slab 550 in the indicated directions causes a continuous, regularly-varying phase shift in the signal propagating within active line 522 relative to another signal traveling in another active line (not shown).

Line impedance $Z_t$ imparted by imnpedance-matching members 554 and 556 is advantageously adjusted by appropriately changing the effective dielectric constant $\in_{eff}$. In the illustrative embodiment shown in FIGS. 5*a* & 5*b*, effective dielectric constant of the line is adjusted by suitably changing the thickness t of impedance-matching members 554 and 556, thereby changing the amount of dielectric material in a cross-section of the impedance-matching members.

In some embodiments, phase-shifting member 552 and impedance-matching members 554 and 556 comprising phase-shifting slab 550 can advantageously be formed from a single dielectric slab having a first thickness. The thickness of phase-shifting member 552 is equal to the first thickness. Slab thickness is simply stepped (i.e., reduced) as appropriate, on each side of the phase-shifting member, to create two impedance-matching members 554 and 556 having thickness t that provide a dielectric loading suitable for reducing or avoiding impedance mismatch. The width of each impedance-matching member advantageously provides 90 degrees of phase. Such impedance-matched phase shifting slabs are simple and inexpensive to manufacture. In other embodiments, the impedance-matching members can be tapered such that there is a uniform increase in thickness over the impedance-matching member.

As is known to those skilled in the art, no simple expression describes the relation between the thickness and width of a layer of dielectric material and that layer's effect on line impedance. The required calculations can be performed using a "method-of-moment" calculation familiar to those skilled in the art. Such calculations tend to be, however, rather tedious, and are usually performed with the aid of a software "tool." In particular, an electromagnetic (EM) simulator, such as Momentumm™, available from Hewlett-Packard Company of Palo Alto, Calif. IE3D™, available from Zeland Software of Frement Calif. and Sonnet™, available from Sonnet Software of Liverpool, N.Y. may be used for this purpose.

In the illustrative embodiment of FIGS. 5*a*, 5*b*, impedance-matching members 554 and 556 provide ninety degrees of phase. Line impedance $Z_t$ of each impedance-matching member is given by the expression:

$$Z_t=(Z_aZ_d)^{1/2} \quad [2]$$

where: $Z_a$ is the line impedance of the air-suspended active line (i. e., air between the active line and the ground plane); and $Z_d$ is the line impedance of the dielectrically-loaded active line (i.e., dielectric material between the active line and the ground plane).

With reference to FIG. 5*b*, $Z_d$ is the line impedance for region 524 of active line 522, and $Z_a$ is the line impedance for region 521 of active line 522.

In the illustrative embodiment shown in FIGS. 5*a* & 5*b*, only one impedance-matching member is disposed on each side of phase-shifting member 552 of phase-shifting slab 550. In other embodiments (not shown), each of the single impedance-matching members are replaced by multiple impedance-matching members. In those other embodiments, each successive impedance-matching member is thicker than the previous one. The use of such multiple impedance-matching members advantageously provides a more gradual impedance transition when signal frequency deviates from the impedance-matching design center frequency. In additional embodiments (not shown), impedance-matching members having a thickness that advantageously varies regularly in the manner of a "wedge" and typically increases to a maximum at the phase-shifting member/impedance-matching member interface. Line impedance imparted by such impedance-matching member varies regularly. Such tapered impedance-matching members represent a logical conclusion of the use of an increasing number of discrete impedance-matching members. The above-described phase-shifting slab configurations and others, are described in aforementioned U.S. patent application Ser. No. 09/040,850.

Figure 6:
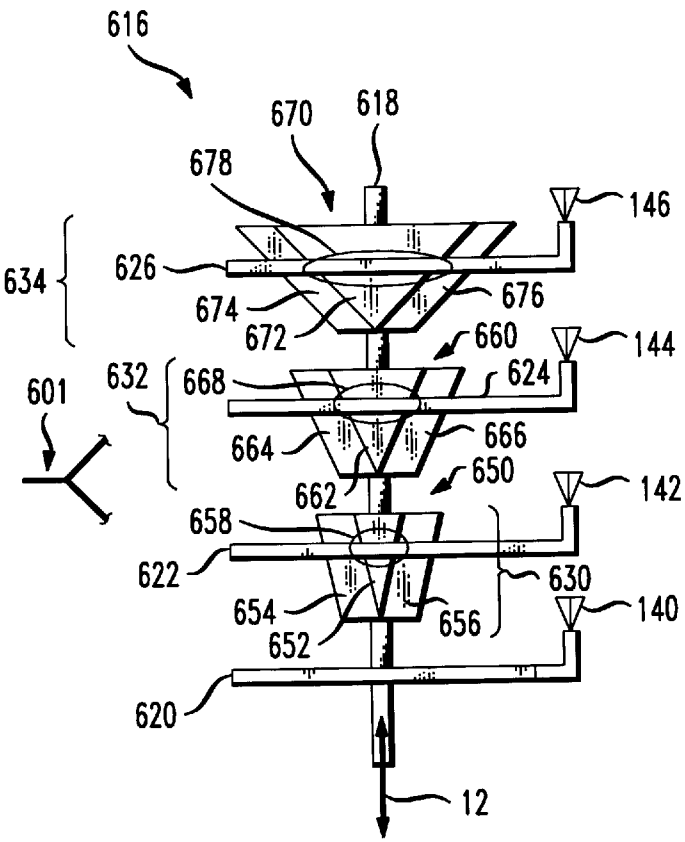
FIG. 6 depicts a portion of a phased-array antenna utilizing an asymmetric corporate feed network, the phased-array antenna including a phase-shifter array having trapezoidal-shaped phase-shifting slabs in accordance with an illustrative embodiment of the present invention.

FIG. 6 depicts a portion of a phased-array antenna in accordance with an illustrative embodiment of the present invention. The phased-array antenna is fed by asymmetric corporate feed network 601. The portion of the phased-array antenna depicted in FIG. 6 shows phase-shifter array 616 for use in conjunction with active lines 622, 624 and 626 leading to radiating elements 142, 144 and 146, respectively. Illustrative phase-shifter array 616 has three phase shifters 630, 632 and 634. Each phase shifter comprises a phase-shifting slab (e.g., slab 650) having a phase-shifting member (e.g., member 652) and at least one impedance-matching member (e.g.,member 654). Illustrative phase-shifting slabs 650–670 are configured like the phase-shifting slab 550 depicted in FIGS. 5*a* & 5*b*. Phase-shifting slabs 650, 660 and 670 are advantageously mechanically linked by linkage 618 in accordance with an illustrative embodiment of the present invention. When inserted at a reference position between active lines 622, 624 and 626, and one or more ground planes (not shown), phase-shifting members 652, 662 and 672 of respective phase-shifting slabs 650, 660 and 670 impart a relative phase difference $\Delta\phi$ to signals traveling along those lines. To the extent that the linkage 618 may affect the dielectric loading of the transmission lines, such effect is invariant; there is no change in dielectric loading associated with movement of the linkage.

In phase-shifter array 616 depicted in FIG. 6, the required progressive increase $\Delta\phi$ in phase shift (for phase shifter 630: $1\Delta\phi$; for phase shifter 632: $2\Delta\phi$; for phase shifter 634: $3\Delta\phi$ is obtained by dielectrically loading a successively greater region of the transmission lines. In FIG. 6, there is no phase shifter for line 620; active line 620 is "air suspended." Phase-shifting slab 650 of phase shifter 630 is inserted between active line 622 and the ground plane (not shown). Region 658 of active line 622 is thus dielectrically-loaded. Such dielectric loading changes the effective dielectric constant of the active line, which, in turn, affects the propagation velocity of a signal traveling through active line 622. A signal traveling through line 622 is therefore phase-shifted relative to a signal traveling through line 620. Phase-shifting slab 660 of phase shifter 632 is inserted between active line 624 and the ground plane. A larger portion of active line 624 (i.e., region 668) is dielectrically loaded than active line 622. The difference between the lengths of regions 668 and 658 accounts for the relative phase change $\Delta\phi$ between signals traveling in lines 622 and 624. Similarly, dielectrically-loaded region 678 of active line 626 is longer than dielectrically-loaded region 668 of active line 624 to introduce a relative phase change $\Delta\phi$ between signals traveling in lines 624 and 626.

The "reference" position of phase-shifting members 652, 662 and 672 generate a reference radiation pattern or antenna beam. As phase-shifter array is moved along direction vector 12 such that the phase-shifting slabs (and the phase-shifting members) are displaced from their reference positions, the phase relationships between radiating elements 140–146 change, resulting in a change in the antenna's radiation pattern. In this manner, the antenna beam is "steered," Due to the smooth, regular increase in width of phase-shifting members 652, 662 and 672 of respective phase shifters 630, 632 and 634, the phase response to slab movement is advantageously linear. In some embodiments, such as the one depicted in FIG. 6, individual phase-shifting slabs are advantageously mechanically linked via rigid linkage 618 so that a single drive mechanism, such as a motor, etc. (not shown), can be used to actuate all three phase shifters. Using a single drive mechanism advantageously lowers antenna cost, and reduces time spent for design and calibration. Moreover, use of a single drive mechanism allows for easy implementation of remote beam steering capabilities. The rate of increase in width (the taper angle) of each phase-shifting member is different from that of every other phase-shifting member. Thus, incremental movement of linkage 618 changes the relative phase relationships between the radiating elements 140–146.

There are many benefits to be gained using a single drive mechanism. When employed, however, phase change cannot be obtained by differentially moving the phase-shifting slabs relative to one another. In phase-shifter array 616, each successive phase-shifting member is larger than the previous one to provide the additional dielectric loading needed to obtain differential phase shift $\Delta\phi$. In a first alternative embodiment, the phase shifters have uniform size but the effective dielectric constant of each successive phase shifter is increased. In a second alternative embodiment, a combination of increasing size and dielectric constant is used.

Each phase-shifting slab 650, 660, and 670 advantageously incorporates respective impedance-matching members 654/656, 664/666, and 674/676. The impedance-matching members shown in FIG. 6 advantageously provide impedance matching over the full shifting range of the accompanying phase-shifting member by virtue of their configuration. Due to such f ill-shifting range impedance-matching members, the phase-shifting members can be advantageously comprised of relatively high-dielectric-constant materials. Using such high-dielectric-constant materials advantageously enables a large beam steering range and/or relatively smaller phase-shifting members. Lower dielectric constant materials should be used in the absence of the present full-shifting range impedance-matching members, since, relative to higher dielectric constant materials, the impedance transitions tend to be more gradual such that signal reflections are less pronounced. Unfortunately, using low dielectric constant materials disadvantageously results in a more restricted beam steering range and larger phase-shifting slabs. As previously described, the dielectric constant of such materials will typically be in a range of from about 2 to about 15.

Figure 7:
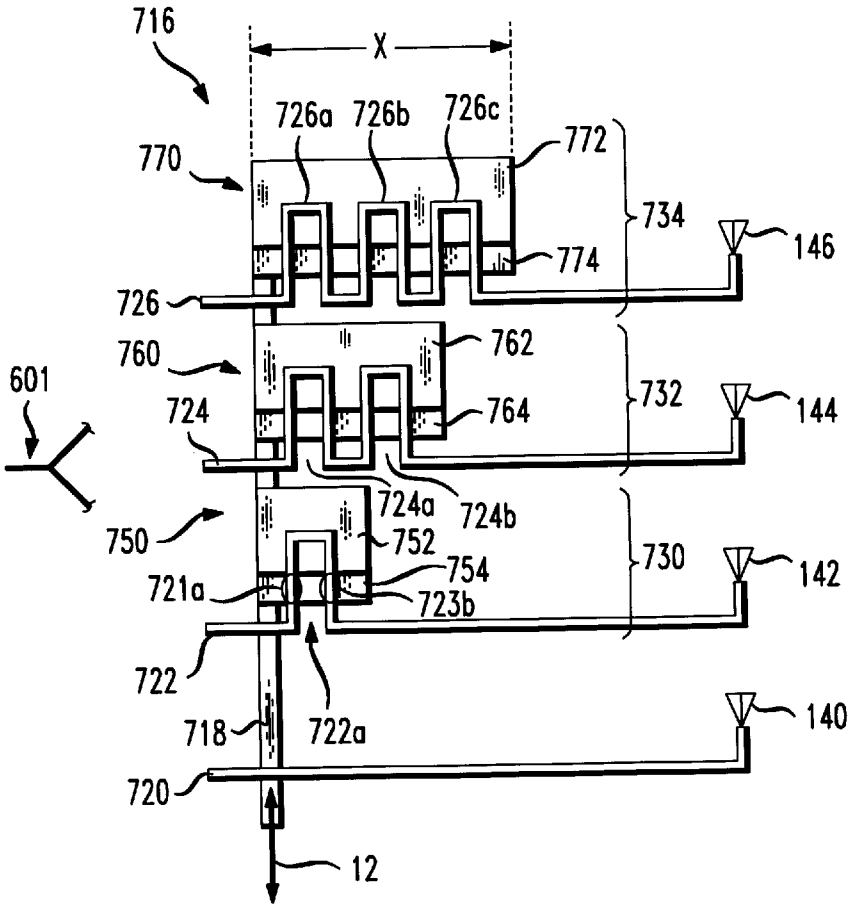
FIG. 7 depicts a portion of a phased-array antenna utilizing an asymmetric corporate feed network, the phased-array antenna including a phase-shifter having rectangular-shaped phase-shifting slabs in accordance with an illustrative embodiment of the present invention.

FIG. 7 depicts a portion of a phased-array antenna in accordance with an illustrative embodiment of the present invention. The phased-array antenna is fed by asymmetric corporate feed network 601. The portion of the phased-array antenna depicted in FIG. 7 shows phase-shifter array 716 for use in conjunction with active lines 722, 724 and 726 leading to radiating elements 142, 144 and 146, respectively. Illustrative phase-shifter array 716 has three phase shifters 730, 732 and 734. As before, each phase shifter comprises a phase-shifting slab advantageously comprising a phase-shifting member and an impedance-matching member. Phase-shifting slabs 750–770 are shown in a reference position in FIG. 7. Unlike previously depicted embodiments, illustrative phase-shifting slabs 750–770 have a rectangular shape. As before, the required progressive increase $\Delta\phi$ in phase shift (for phase shifter 730: $1\Delta\phi$; for phase shifter 732: $2\Delta\phi$; for phase shifter 734: $3\Delta\phi$) is obtained by increasing the dielectric loading of each successive transmission line. That increase is obtained in two ways in the illustrative phased-array antenna depicted in FIG. 7. First, each successive phase-shifting member is longer than the preceding one. That is, phase-shifting member 762 is longer than phase-shifting member 752, and phase-shifting member 772 is longer than phase-shifting member 762. The increase in dielectric loading is also obtained by forming an increasing number of regions, within each successive active line, wherein the amount of active line accessible for dielectric loading (for a given distance x shown in FIG. 7) is increased versus a straight portion of active line (over the same distance x). In the illustrative embodiment shown in FIG. 7, such "loading-enhancing" regions are realized by forming "u-shaped" regions, in increasing number, in each successive active line. Thus, by virtue of u-shaped region 722*a*, more active line is accessible to the phase-shifting member 752 for dielectric loading than would be available if no such region was present. Line 724 includes two u-shaped regions 724*a* and 724*b*, and line 726 includes three u-shaped regions 726*a*, 726*b* and 726*c*. In the absence of such "loading-enhancing" regions, the phase-shifting members would have to be longer so that they could dielectrically load additional transmission line.

It will be appreciated that the configuration and number of loading-enhancing regions in a given active line is variable (subject to limitations imposed by the extent to which the line is contortable, the actual length of the particular phase-shifting member, and the required amount of phase shift). Relative to the illustrative phased array of FIG. 6, the phased-array of FIG. 7 requires more active line for a given amount of phase shift.

Phase-shifting slabs 750–770 incorporate respective impedance-matching members 754, 764 and 774. Although each is physically a "single" member having a different effective dielectric constant than its associated phase-shifting member (i.e., 752, 762 and 772, respectively), impedance-matching members 754, 764 and 774 are functionally each plural impedance-matching members. Specifically, for phase-shifting slab 750, impedance-matching member 754 provides impedance matching at region 721*a* for the transition from air-suspended line to dielectrically-loaded line (over the phase-shifting member 752), and again at region 723*a* for the transition from dielectrically-loaded line to air-suspended line. Thus, impedance-matching member 754 is the functional equivalent of two separate impedance matching members.

Like the illustrative embodiment depicted in FIG. 6, phase-shifting slabs 750–770 are advantageously mechanically linked via rigid linkage 718 so that a single (drive mechanism can be used to actuate all three phase shifters.

Figure 8B:
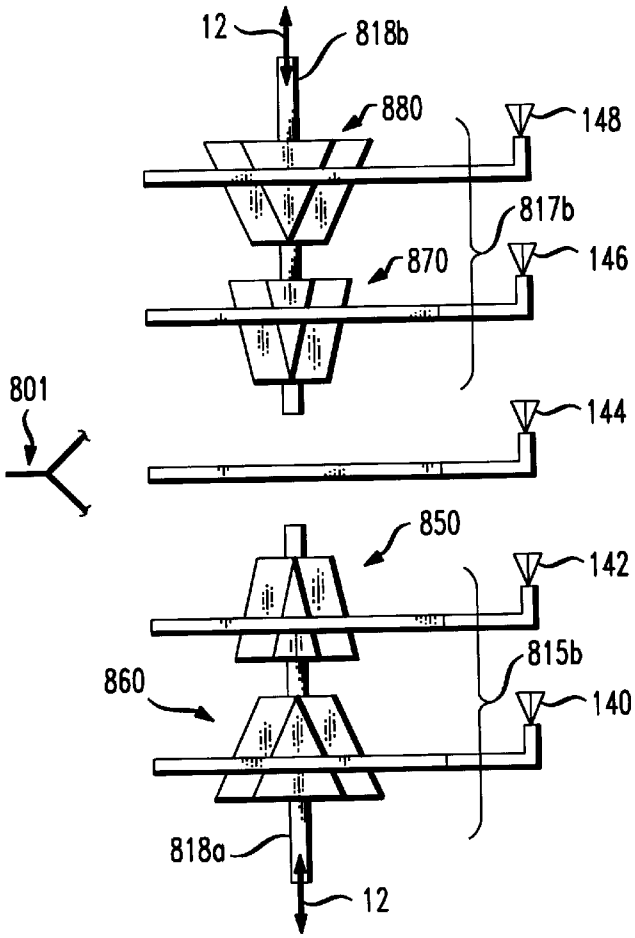
FIG. 8*b* depicts a portion of a phased-array antenna utilizing a symmetric corporate feed network, the phased-array antenna including two, independently drive phase-shifter sub-arrays having trapezoidal-shaped phase-shifting slabs in accordance with an illustrative embodiment of the present invention.
Figure 8A:
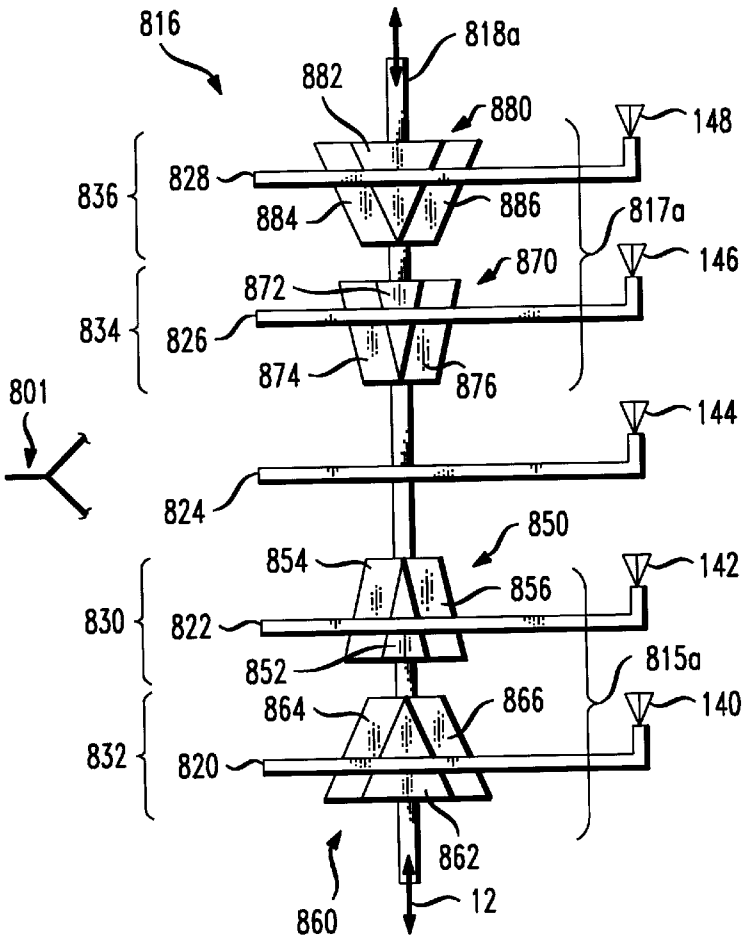
FIG. 8*a* depicts a portion of a phased-array antenna utilizing a symmetric corporate feed network, the phased-array antenna including a phase-shifter array having trapezoidal-shaped phase-shifting slabs in accordance with an illustrative embodiment of the present invention.

FIG. 8*a* depicts a portion of a phased-array antenna in accordance with an illustrative embodiment of the present invention. In the illustrative embodiment of FIG. 8*a*, the phased-array antenna is fed by symmetric corporate feed network 801. The portion of the phased-array antenna depicted in FIG. 8*a* shows phase-shifter array 816 for use in conjunction with active lines 820, 822, 824, 826 and 828 leading to radiating elements 140, 142, 144, 146 and 148, respectively. Illustrative phase-shifter array 816 has four phase shifters 830, 832, 834 and 836 that are grouped in two sub-arrays 815*a* and 817*a*. Phase shifters 830 and 832 comprise sub-array 815*a*, and phase shifters 834 and 836 comprise sub-array 817*b*. As previously described, using asymmetric corporate feed network reduces the tuning range of the final phase shifter by a factor of two, as compared to an asymmetric corporate feed network. Each phase-shifting slab 850, 860, 870 and 880 of each phase shifter advantageously comprises respective phase-shifting member 852, 862, 872 and 882, and includes two imnpedance-matching members 854/856, 864/866, 874/876 and 884/886 configured to provide impedance matching over the full shifting range of each phase-shifting member.

In a phased array having a symmetrical feed network, such as the phased array depicted in FIG. 8*a*, the antenna beam can be steered by adding successive phase delay in one sub-array while diminishing it in the other sub-array. Illustrative phase-shifter array 816 depicts one way in which that is accomplished. In accordance with an illustrative embodiment of the present invention, sub-arrays 815*a* and 817*a* are advantageously mechanically linked via rigid linkage 818, and one sub-array is the mirror image of the other. In a reference position depicted in FIG. 8*a*, phase-shifting slabs 850 and 870 provide respective phase shifts of $-1\Delta\phi$ and $1\Delta\phi$, and phase-shifting slabs 860 and 880 provide respective phase shifts of $-2\Delta\phi$ and $2\Delta\phi$. To steer the antenna beam, phase delay is increased in one of the sub-arrays 815*a* or 817*a* by increasing the dielectric loading, and decreased in the other one of the sub-arrays 817*a* or 815*a* by decreasing the dielectric loading. It should be apparent from FIG. 8*a* that the required increase and decrease in dielectric loading is readily obtained as rigid linkage 818 is moved as indicated by direction vector 12. Advantageously, the phased-array antenna depicted in FIG. 8*a* can be steered using a single drive mechanism.

FIG. 8*b* depicts a portion of a phased-array antenna in accordance with an illustrative embodiment of the present invention. Although otherwise identical to the phased-array antenna of FIG. 8*a*, in the illustrative embodiment of FIG. 8*b*, sub-arrays 815*b* and 817*b* are not mechanically linked. Rather, phase-shifting slabs 850 and 860 comprising sub-array 815*b* are mechanically linked via rigid linkage 818*a*, and phase-shifting slabs 870 and 880 comprising sub-array 817*b* are mechanically linked via rigid linkage 818*b*. By decoupling sub-array movement such that each is driven by its own driving mechanism, the phased-array antenna of FIG. 8*b* is operable to adjust array beam width (i.e., gain), as well as to simply steer the antenna beam. For example, if phase delay is increased in one sub-array and decreased in the other sub-array, the beam tilts. If phase delay is increased or decreased in both sub-arrays, then the beam is widened and gain is decreased.

Figure 9:
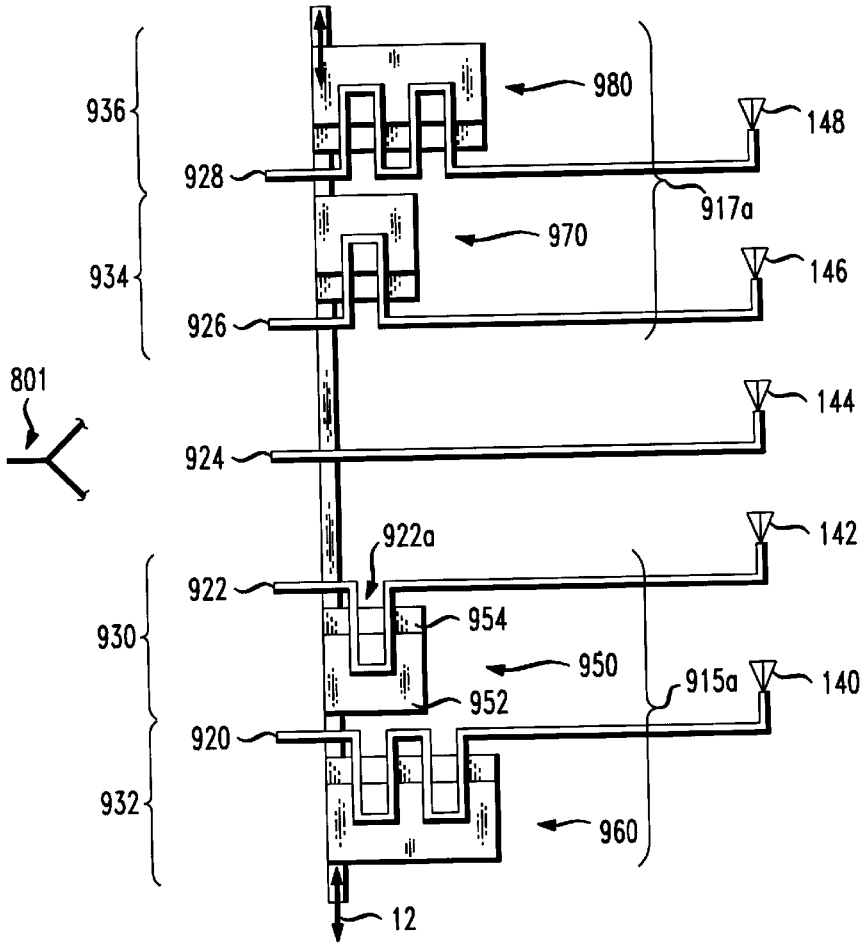
FIG. 9 depicts a portion of a phased-array antenna utilizing a symmetric corporate feed network, the phased-array antenna including a phase-shifter array having rectangular-shaped phase-shifting slabs in accordance with an illustrative embodiment of the present invention.

FIG. 9 depicts a portion of a phased-array antenna in accordance with an illustrative embodiment of the present invention. The illustrative phased-array antenna of FIG. 9 incorporates phase shifters 930, 932, 934 and 936 having rectangular-shaped phase-shifting slabs 950–980 and active lines 920–928 including loading-enhancing regions (e.g., 922*a*, etc.) as previously described in conjunction with FIG. 7. Each of the phase-shifting slabs includes a phase-shifting member (e.g., member 952) and an impedance-matching member (e.g., member 954). The phase shifters are grouped into mechanically linked sub-arrays 915*a* and 917*a* in the manner of the illustrative phased array antenna depicted in FIG. 8*a*. As phase delay is increased in one of the sub-arrays 915*a* or 917*a*, it is decreased in the other of the sub-arrays 917*a* or 915*a*. In another embodiment (not shown), the sub-arrays are advantageously decoupled, as in the embodiment depicted in FIG. 8*b*, providing adjustable array gain and beam width, in addition to beam steering. Like the illustrative phased-array antennas of FIGS. 8*a* & 8*b*, the array antenna of FIG. 9 uses a symmetrical corporate feed network.

Figure 10:
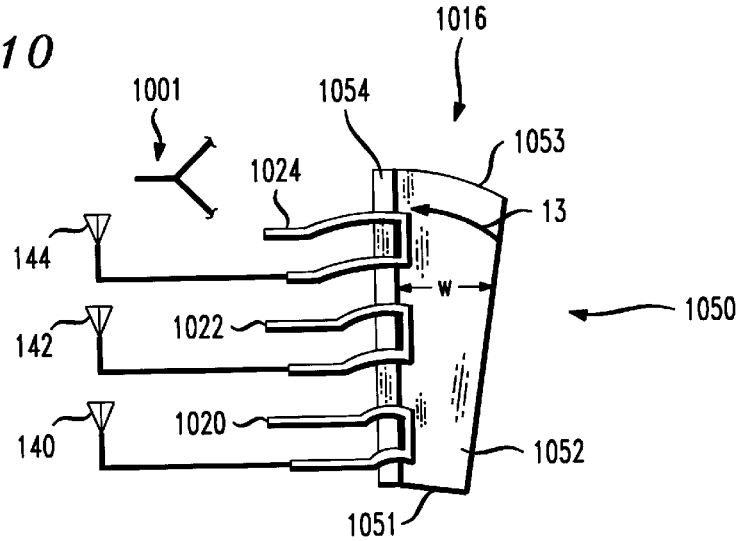
FIG. 10 depicts a portion of a phased-array antenna utilizing an asymmetric corporate feed network, the phase-array antenna including a phase-shifter array having one rotating phase-shifting slab in accordance with an illustrative embodiment of the present invention.
Figure 12:
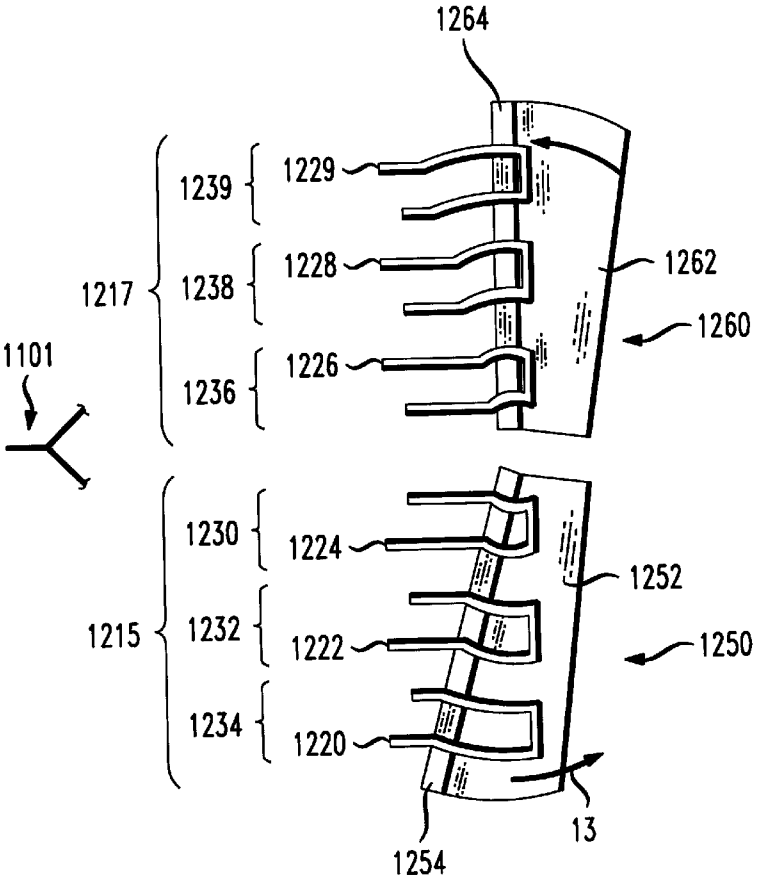
FIG. 12 depicts a portion of a phased-array antenna utilizing a symmetric corporate feed network, the phase-array antenna including two, independently driven phase-shifter sub-arrays each having one rotating phase-shifting slab in accordance with an illustrative embodiment of the present invention.
Figure 11:
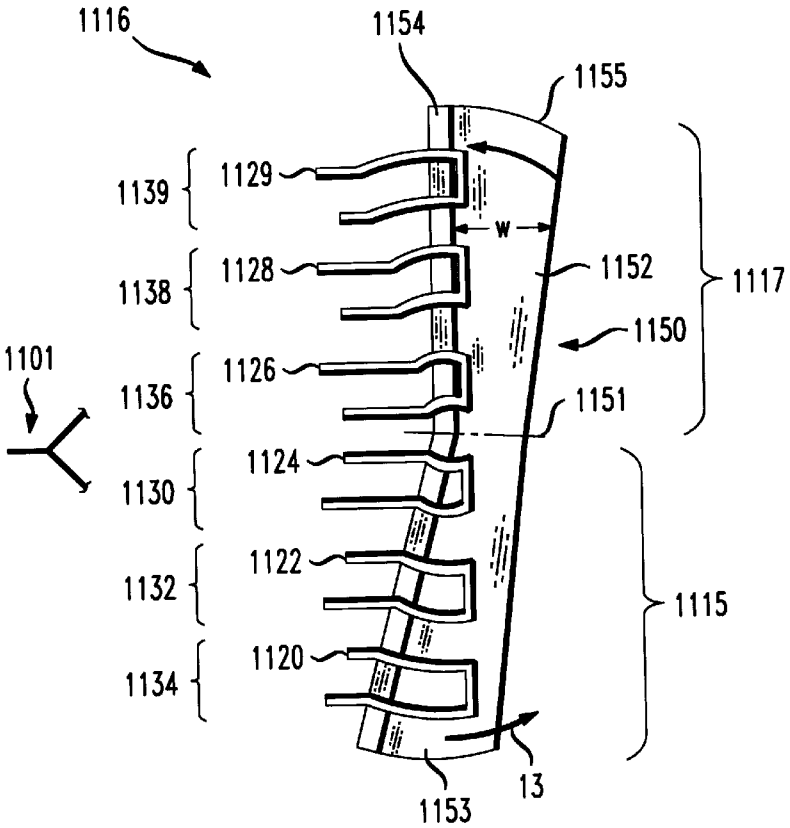
FIG. 11 depicts a portion of a phased-array antenna utilizing a symmetric corporate feed network, the phase-array antenna including a phase-shifter array having one rotating phase-shifting slab in accordance with an illustrative embodiment of the present invention.

FIGS. 10–12 depict corporate-fed phased-array antennas utilizing phase-shifter arrays having one or two rotatable phase-shifting slabs including a phase-shifting member and impedance-matching member in accordance with further illustrative embodiments of the present invention. The impedance-matching member advantageously provides impedance matching over the full phase-shifting range of the phase-shifting member.

In particular, FIG. 10 depicts a phased-array antenna that is fed by asymmetric corporate feed network 1001. Unlike previous illustrative embodiments, phase-shifter array 1016 advantageously includes single phase-shifting slab 1050 that is the functional equivalent, in FIG. 10, of three phase-shifting slabs, one each for active lines 1020, 1022 and 1024 leading to respective radiating elements 140, 142 and 144. Phase-shifting slab 1050 includes phase-shifting member 1052 and impedance-matching member 1054. Phase-shifting member 1052 varies in width w from a minimum at slab edge 1051 to a maximum at slab edge 1053. Slab 1050 is driven in rotational fashion as indicated by direction vector 13. For a given amount of rotation, the dielectric loading of successive active lines 1020, 1022 and 1024 increases providing the relative phase shift required between signals traveling in each line. Phase-shifter array 1016 is advantageously driven by a single drive mechanism (not shown).

FIG. 11 depicts a phased-array antenna that is fed by symmetric corporate feed network 1101. Like phase-shifter array 1016, phase-shifter array 1116 includes single phase-shifting slab 1150 that is the functional equivalent, in FIG. 11, of six phase-shifting slabs, one each for active line 1120–1129 leading to radiating elements (not shown), such that six phase shifters 1130–1139 result. Phase-shifting slab 1150 includes phase-shifting member 1152 and impedance-matching member 1154. Phase-shifting member 1152 increases in width w in the radial direction from axis 1151 toward edges 1153 and 1155. Phase-shifters 1132–1139 are grouped into two sub-arrays 1115 and 1117. As phase-shifting slab 1150 is rotated in the direction indicated by direction vector 13, phase delay is increased by the phase shifters in sub-array 1117, and decreased by the phase shifters in sub-array 1115.

FIG. 12 depicts a phased-array antenna that is fed by symmetric corporate feed network 1101. Unlike the phased-array antenna of FIG. 11, the presently described phased-array includes two phase-shifting slabs 1250 and 1260, each having respective phase-shifting members 1252 and 1262, so that sub-arrays 1215 and 1217 can advantageously be decoupled, in the manner of sub-arrays 815*b* and 817*b* of the illustrative phased-array antenna of FIG. 8*b*. Thus, a first drive mechanism (not shown) advantageously drives sub-array 1215 comprising phase shifters 1230, 1232 and 1234, and a second drive mechanism (not shown) advantageously drives sub-array 1217 comprising phase shifters 1236, 1238 and 1239. As previously described, such decoupled phase-shifter arrays provide for adjustable array gain and main beam and sidelobe width. Each dielectric phase-shifting slab advantageously includes a fill phase-shifting range impedance-matching member (i.e., 1254 & 1264).

FIGS. 6–12 described above depict a variety of illustrative configurations of phased-array antennas that include corporate feed networks and phase-shifter arrays, all in accordance with illustrative embodiments of the present invention. For some applications, it is advantageous to provide a phased-array antenna having a series feed network. As described earlier in this specification, the tuning range of each phase shifter in a series-fed array has a maximum phase shift of only 1Δϕ, (when the phase shifters are inserted into the feed line of the network) as compared to (n−1)Δϕ for a corporate-fed array. As such, in most embodiments, a more compact arrangement is realized when combining a phase-shifter array with a series-feed network than with a corporate-feed network (since the phase-shifting members can be smaller). Several examples of series-fed phased-array antennas are illustrated in FIGS. 13–18 and described below. All of such embodiments utilize phase shifters having impedance-matching members that are advantageously configured to match impedance over the complete phase-shifting range. The use of such "full range" impedance-matching members is particularly advantageous in a series-fed phased array since impedance mismatch (e.g., due from the phase shifters) is additive from radiating element to element.

Figure 13:
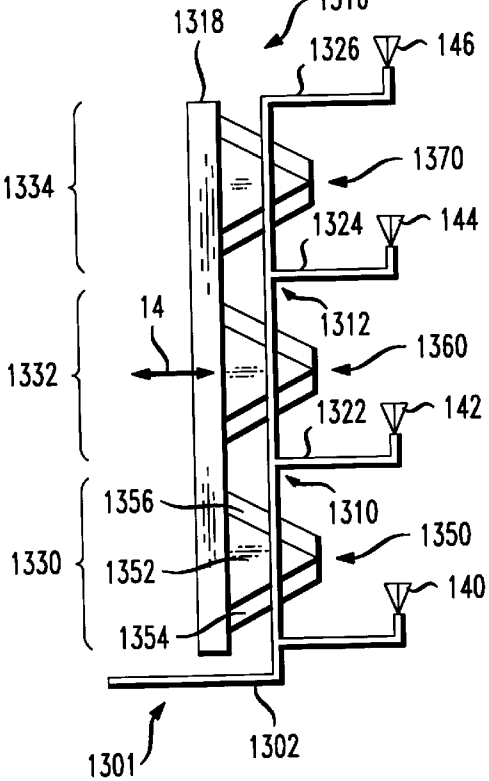
FIG. 13 depicts a portion of a phased-array antenna utilizing an asymmetric series feed network, the phase-array antenna including a phase-shifter array having trapezoidal-shaped phase-shifting slabs in accordance with an illustrative embodiment of the present invention.

FIG. 13 depicts a portion of a phased-array antenna in accordance with an illustrative embodiment of the present invention. The phased-array antenna is fed by asymmetric series feed network 1301. The portion of the phased-array antenna depicted in FIG. 13 shows phase-shifter array 1316 comprising phase shifters 1330–1334 for use in conjunction with series feed line 1302. The phase shifters depicted in the illustrative embodiment of FIG. 13 include three identical phase-shifting slabs 1350–1370, each of which is configured like phase-shifting slab 550 depicted in FIGS. 5*a* & 5*b*. Each phase-shifting slab includes a phase-shifting member (e.g., member 1352) and two impedance-matching members (e.g., members 1354 & 1356). Phase-shifting slabs 1350–1370 are advantageously mechanically linked by linkage 1318 in accordance with an illustrative embodiment of the present invention.

If all phase-shifting slabs are in a reference position, the series feed arrangement provides branch line 1322–1326 with signals having amplitude and phase (modulo 2π) that results in a reference antenna radiation pattern. By moving phase-shifting slab 1350 away from its reference position, a phase difference of 1Δϕ is added to the reference position phase of radiating element 142. Power splitter 1310 directs a minor portion of the phase-shifted signal to line 1322 leading to radiating element 142. The remaining portion of the signal in feed line 1302 can then be phase shifted another 1Δϕ from the reference position via phase shifter 1332. A portion of the phase-shifted signal is directed, via power splitter 1312, to line 1324 leading to radiating element 144. Advantageously positioned in the network feed line, phase shifter 1332 provides a maximum phase shift of only 1Δϕ, yet associated radiating element 144 is phase shifted by an amount 2Δϕ, relative to radiating element 140. As previously described, in an asymmetric corporate feed network, the second phase shifter would be required to provide a maximum phase shift of 2Δϕ. The signal remaining in feed line 1302 is again phase shifted an amount 1Δϕ, this time by phase shifter 1334, and delivered, via line 1326, to radiating element 148. Thus, relative to radiating element 140, radiating element 148 is phase shifted an amount 3Δϕ.

As phase-shifter array 1316 is moved in a direction indicated by direction vector 14, phase shift is imparted as phase-shifting slabs 1350–1370 are moved away from their reference position and the dielectric loading of feed line 1302 is changed.

Figure 14:
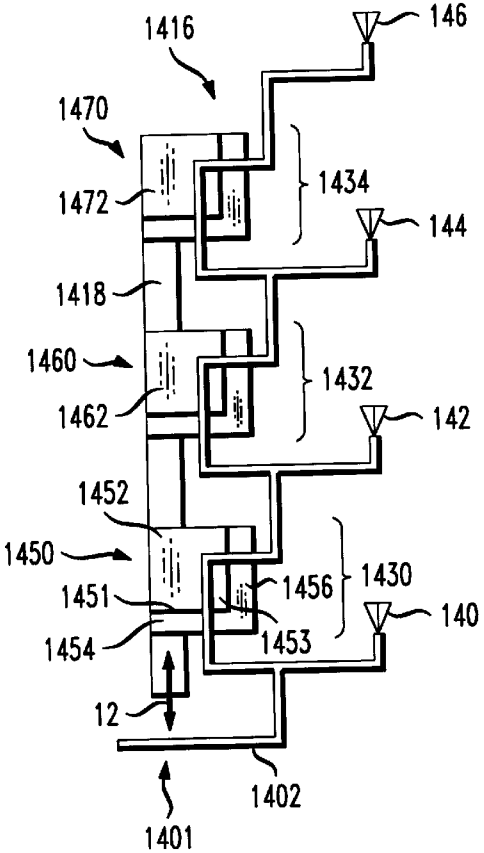
FIG. 14 depicts a portion of a phased-array antenna utilizing an asymmetric series feed network, the phase-array antenna including a phase-shifter array having rectangular-shaped phase-shifting slabs in accordance with an illustrative embodiment of the present invention.

FIG. 14 depicts a portion of a phased-array antenna in accordance with an illustrative embodiment of the present invention. The phased-array antenna is fed by asymmetric series feed network 1401. The portion of the phased-array antenna depicted in FIG. 14 shows phase-shifter array 1416 comprising phase shifters 1430–1434 for use in conjunction with series feed line 1402. The phase shifters depicted in the illustrative embodiment of FIG. 14 include three identical phase-shifting slabs 1450–1470, each of which has a rectangular configuration. Each phase-shifting slab includes a phase-shifting member (e.g., member 1452) and two impedance-matching members (e.g., members 1454 & 1456) depending from two adjacent edges (e.g., edges 1451 and 1453) of the phase-shifting member. The "L" configuration of the impedance-matching members provides impedance matching for the "L-shaped" regions of active line over the full phase-shifting range of the phase-shifting members. Phase-shifting slabs 1450–1470 are advantageously mechanically linked by linkage 1418 in accordance with an illustrative embodiment of the present invention.

Phase-shifting slabs 1450–1470 advantageously cooperate with feed line 1402 for phase shifting as in the manner of the phased-array of FIG. 13, wherein each phase shifter is required to provide a maximum phase differential of only 1Δϕ. As phase-shifter array 1416 is moved in a direction indicated by direction vector 12, phase shift is imparted as phase-shifting members 1452–1472 are moved away from their reference position shown in FIG. 14 such that the dielectric loading of transmission line 1402 is changed.

Figure 15:
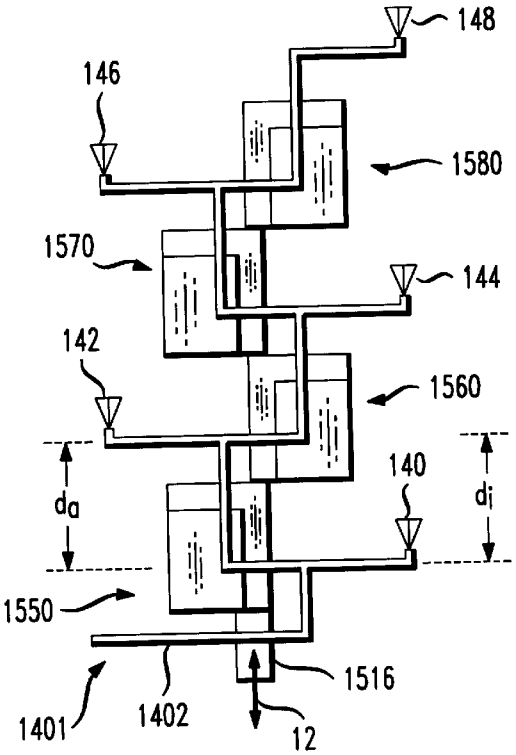
FIG. 15 depicts a portion of a phased-array antenna utilizing an asymmetric series feed network, the phase-array antenna including a phase-shifter array having rectangular-shaped phase-shifting slabs in a compact arrangement in accordance with an illustrative embodiment of the present invention.

FIG. 15 depicts a portion of a phased-array antenna in accordance with an illustrative embodiment of the present invention. The phased-array antenna depicted in FIG. 15 presents a more compact phase-shifting implementation than FIG. 14. Like the antenna of FIG. 14, rectangular-shaped phase-shifting slabs are inserted into the feed line 1402 of asymmetric series feed network 1401. In the embodiment depicted in FIG. 15, the distance $d_1$ between the output lines for adjacent radiating elements is about the same as the distance $d_a$ between consecutive radiating elements (e.g., radiating elements 140 and 142). One phase-shifting slab can be accommodated in distance $d_1$ but, to do so, output lines to radiating elements 140–148 and the phase-shifting members themselves alternate on either side of an axis aligned with linkage 1516.

Figure 18:
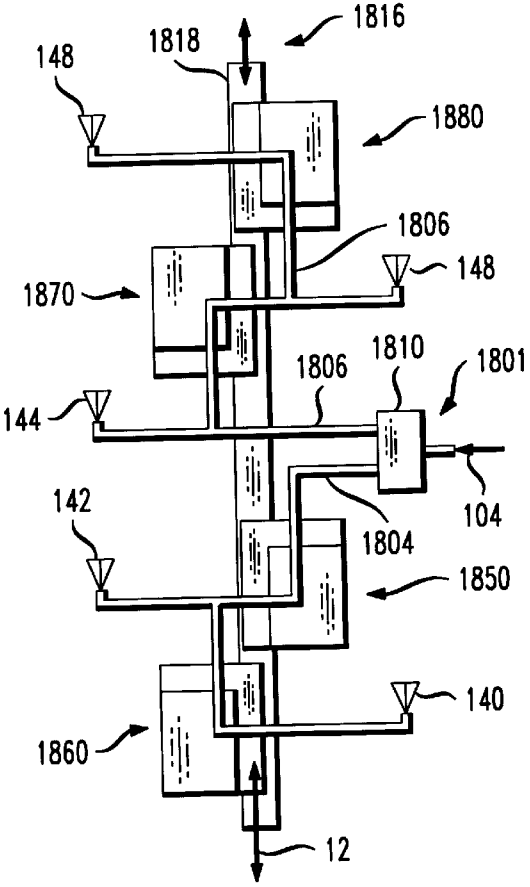
FIG. 18 depicts a portion of a phased-array antenna utilizing a symmetric series feed network, the phase-array antenna including a phase-shifter array having rectangular-shaped phase-shifting slabs in a compact arrangement in accordance with an illustrative embodiment of the present invention.
Figure 17:
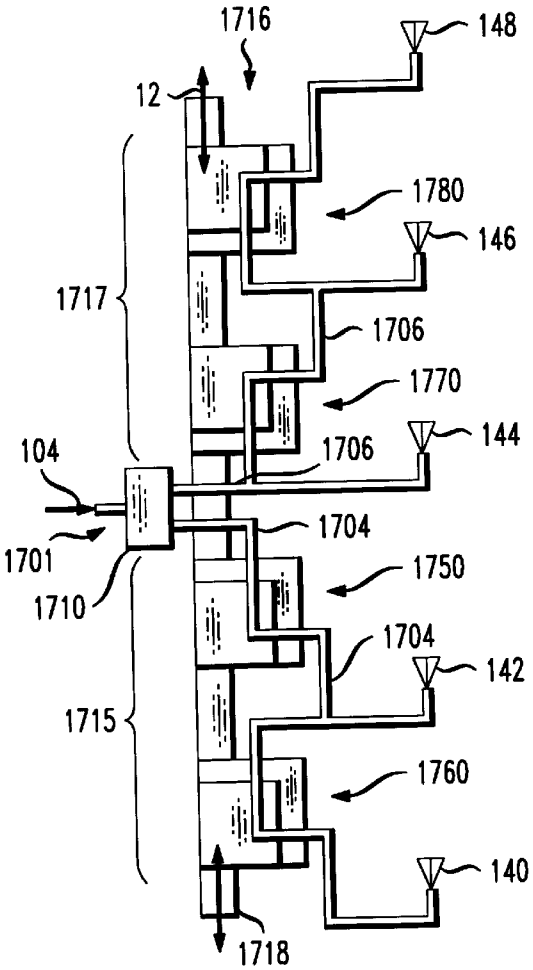
FIG. 17 depicts a portion of a phased-array antenna utilizing a symmetric series feed network, the phase-array antenna including a phase-shifter array having rectangular-shaped phase-shifting slabs in accordance with an illustrative embodiment of the present invention.
Figure 16:
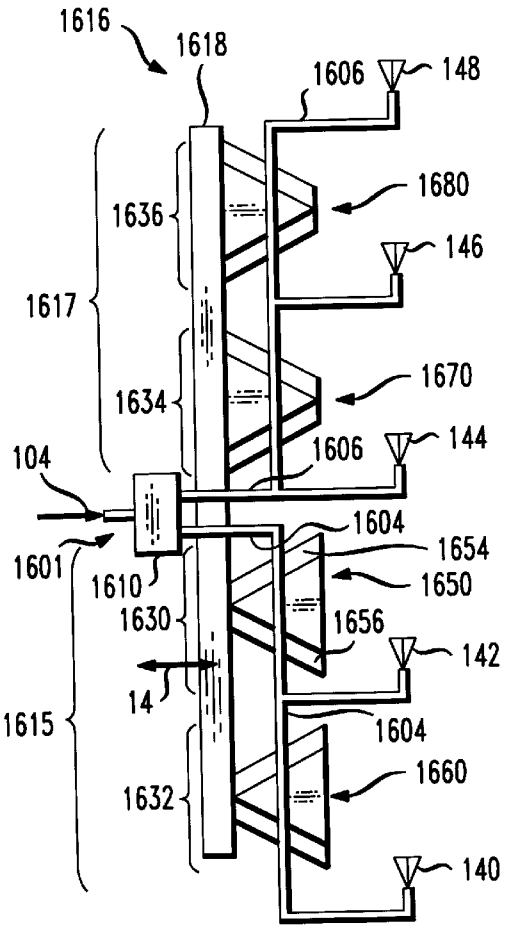
FIG. 16 depicts a portion of a phased-array antenna utilizing a symmetric series feed network, the phase-array antenna including a phase-shifter array having trapezoidal-shaped phase-shifting slabs in accordance with an illustrative embodiment of the present invention.

FIGS. 16–18 depict illustrative embodiments of phased-array antennas similar to the phased-array antennas of FIGS. 13–15, but utilize symmetric, rather than asymmetric series, feed networks. Each of the phased-array antennas of FIGS. 16–18 include radiating elements 140–148.

FIG. 16 depicts a portion of a phased-array antenna in accordance with an illustrative embodiment of the present invention. The phased-array antenna of FIG. 16 is fed by symmetric series feed network 1601. The portion of the antenna depicted in FIG. 16 includes phase-shifter array 1616, including upper sub-array 1617 and lower sub-array 1615. Upper sub-array 1617 comprises phase shifters 1636 and 1634, and lower sub-array 1615 comprises phase shifters 1632 and 1630. Power splitter 1610 directs a first portion of input signal 104 to feed line 1604 and a second portion to feed line 1606. In a reference position depicted in FIG. 16, each phase shifter provides a phase differential of 1Δϕ.

Like the illustrative embodiments of symmetrical corporate-fed phased-arrays depicted in FIGS. 8*a* & 9, the beam generated by the illustrative symmetrical series fed phased-array shown in FIG. 16 can be steered by increasing phase delay in one of the sub-arrays while decreasing it in the other sub-array. Illustrative phase-shifter array 1616 depicts one way in which that is accomplished. hn accordance with an illustrative embodiment of the present invention, sub-arrays 1615 and 1617 are advantageously mechanically linked via rigid linkage 1618. Phase-shifting slabs 1650 and 1660 of lower sub-array 1615 are oriented with their apex toward rigid linkage 1618, while phase-shifting slabs 1670 and 1680 of upper sub-array 1617 are oriented with their base toward rigid linkage 1618. As such, movement of linkage 1618 toward feed lines 1604 & 1606 decreases the dielectric loading of line 1604, and, conversely, increases the dielectric loading of line 1606.

To steer the antenna beam, linkage 1618 is moved toward or away from feed lines 1604 and 1606. Phase delay increases in one of the sub-arrays 1615 or 1617 as the dielectric loading in respective feed lines 1604 or 1606 increase and decreases in the other one of the sub-arrays 1617 or 1615 as the dielectric loading in respective feed lines 1606 or 1604 is decreased. Due to rigid linkage 1618, and the "inverted" relative configurations of the phase-shifting slabs in the two sub-arrays, beam steering is advantageously accomplished using a single drive mechanism. Phase-shifting slabs 1650–1680 advantageously include impedance-matching members (e.g, 1654 & 1656).

FIGS. 17 & 18 depict phased array antennas in accordance with illustrative embodiments of the present invention. The configuration of those array antennas is obtained by replacing the asymmetric series feed networks of the phased arrays of FIGS. 14 & 15 with symmetric series feed networks 1701 and 1801. The phased arrays depicted in FIGS. 17 & 18 include respective phase-shifter arrays 1716 and 1816, each of which are comprised of respective sub-arrays 1715/1717 and 1815/1817. Each sub-array is comprised of two phase shifters, each including a phase-shifting slab with a phase-shifting member and impedance-matching members. Phase-shifting slabs 1750-1780 of phase-shifter array 1716 are mechanically linked via rigid linkage 1718, and phase-shifting slabs 1850–1880 of phase-shifter array 1816 are mechanically linked via rigid linkage 1818. Power splitter 1710 directs a first portion of signal 104 to feed line 1704 and a second portion to feed line 1706. Power splitter 1810 likewise directs a first portion of signal 104 to feed line 1804 and a second portion to feed line 1806. In a reference position depicted in FIGS. 17 & 18, each phase shifter provides a phase differential of $1\Delta\phi$. Like the array antenna of FIG. 16, the beam generated from the antennas depicted in FIGS. 17 & 18 can be steered by increasing phase delay in one of the sub-arrays while decreasing it in the other sub-array. Since the phased arrays of FIG. 16 and FIG. 17 are series fed, the dielectric phase-shifting slabs advantageously include impedance-matching members operable over the full phase shifting range.

In the phased array depicted in FIG. 8*b*, sub-arrays 815*b* and 817*b* are mechanically independent of one another (i.e., interconnecting rigid linkage 818 of FIG. 8*a* is removed). A separate drive mechanism is provided for each sub-array. The phased-arrays depicted in FIGS. 16–18 can be similarly modified. As previously described, decoupling sub-arrays in that manner provides a phased-array with the ability to adjust array gain and beam width.

Additional description of ways to integrate the present phase-shifter arrays into series-feed networks is provided in aforementioned U.S. patent application Ser. No. 09/040,848.

It is to be understood that the embodiments described herein are merely illustrative of the many possible specific arrangements that can be devised in application of the principles of the invention. Other arrangements can be devised in accordance with these principles by those of ordinary skill in the art without departing from the scope and spirit of the invention. It is therefore intended that such other arrangements be included within the scope of the following claims and their equivalents.

We claim:

1. A steerable phased-array antenna, comprising:

a first plurality of radiating elements; and a phase-shifter array comprised of a second plurality of phase shifters, the phase-shifter array including at least one phase-shifting slab that affects the phase of signals when the phase-shifting slab is disposed in electromagnetic fields generated by the signals, each phase-shifting slab including:

a phase-shifting member that changes the phase of the signal generating the electromagnetic field as the phase-shifting member deviates from a reference position within the electromagnetic field, wherein the phase-shifting member is comprised of a dielectric material; and an impedance-matching member that reduces an impedance step change occurring in a region of transmission line in which the signal propagates due to the presence of the phase-shifting member in the electromagnetic field generated by a signal; wherein, each phase-affected signal is delivered to a different one of the radiating elements.

2. The antenna of claim 1, wherein the impedance-matching member is operable to reduce the impedance step change over substantially a full phase-shifting range of the phase-shifting member.

3. The antenna of claim 2, wherein as the phase-shifting member deviates from the reference position, there is substantially no change in signal phase due to the impedance-matching member.

4. The antenna of claim 3 wherein each phase shifter in the phase-shifter array comprises a discrete phase-shifting slab, such that the phase-shifter array comprises a plurality of such phase-shifting slabs, each having a phase-shifting member and an impedance-matching member.

5. The antenna of claim 4, wherein the phase-shifting slabs comprising the phase-shifter array are mechanically linked via a rigid linkage.

6. The antenna of claim 5, wherein a single driving mechanism is operable to move the phase-shifter array.

7. The antenna of claim 3, wherein the phase-shifting member is physically configured to provide a substantially uniform change in an amount of dielectric material present in the electromagnetic field as it deviates from the reference position, wherein the deviation is caused by movement along a first axis.

8. The antenna of claim 7, wherein the uniform change is linear.

9. The antenna of claim 8, wherein the physical configuration is substantially, triangular and the first axis coincides with a line of symmetry that bisects the substantially triangular-shaped phase-shifting member and passes through a base and apex of the substantially triangular-shaped phase-shifting member.

10. The antenna of claim 9, wherein the impedance-matching member is disposed adjacent to a first side of the triangular-shaped phase-shifting member and a second impedance-matching member is disposed adjacent to a second side of the triangular-shaped phase-shifting member.

11. The antenna of claim 10, wherein the phase-shifting slab has a trapezoidal shape.

12. The antenna of claim 7, wherein the phase-shifting slabs comprising the phase-shifter array are mechanically linked via a rigid linkage, and further wherein each successive phase shifter provides a different amount of dielectric-loading and therefore a different amount of phase shift, wherein dielectric loading is defined as a length of transmission line that has a changed effective dielectric constant due to the presence of dielectric material in the electromagnetic field generated by a signal traveling in the transmission line.

13. The antenna of claim 12, further comprising a loading-enhancing region which allows a greater amount of dielectric loading over a given straight-line distance than is obtained with a linear transmission line over the same straight-line distance.

14. The antenna of claim 13, wherein the phase-shifting slabs have a rectangular s tape and further wherein successive phase-shifting members have different sizes.

15. The antenna of claim 7, wherein the phase shifters comprising the phase-shifted array are arranged into a first and a second sub-array, wherein, within each sub-array, each phase shifter provides a different amount of dielectric loading, defined as a length of transmission line that has a changed effective dielectric constant due to the presence of dielectric material in the electromagnetic field generated by a signal traveling in the transmission line, and further wherein, in comparison to one another, the two sub-arrays have identical phase-shifting slabs in terms of shapes and sizes, and further wherein the two sub-arrays are aligned along a first axis in mirror-image fashion such that, moving away from a reference point between the two sub-arrays, the first and each successive phase-shifting slab in the first sub-array are identical to the first and each successive phase-shifting slab in the second sub-array.

16. The antenna of claim 15, wherein the phase-shifting slabs within the first sub-array are mechanically linked by a first linkage and driven by a first driving mechanism, and the phase-shifting slabs within the second sub-array are mechanically linked by a second linkage and driven by a second driving mechanism.

17. The antenna of claim 1, wherein the phase-shifter array comprises only one phase-shifting slab that is driven in a circular motion and is operable to differentially shift, relative to one another, the phases of a plurality of signals.

18. The antenna of claim 3, wherein the phase-shifter array comprises a first and a second phase-shifting slab, and further wherein, the first phase-shifting slab is driven in a circular motion and is operable to differential shift, relative to one another, the phases of a first plurality of signals; and the second phase-shifting slab is driven in a circular motion and is operable to differentially shift, relative to one another, the phases of a second plurality of signals.

19. The antenna of claim 4, wherein the phase-shifting slabs comprising the phase-shifter array are mechanically linked via a rigid linkage, and further wherein, when in use, the phase-shifting slabs are disposed in the electromagnetic fields of signals traveling in feed network lines, and further wherein each successive phase shifter provides an equal amount of dielectric-loading and therefore an equal amount of phase shift, wherein dielectric loading is defined as a length of transmission line that has a changed effective dielectric constant due to the presence of dielectric material in the electromagnetic field generated by a signal traveling in the transmission line.

20. The antenna of claim 4, wherein the phase shifters comprising the phase-shifted array are arranged into a first and a second sub-array, wherein, within each sub-array, each phase shifter provides an equal amount of dielectric loading, defined as a length of transmission line that has a changed effective dielectric constant due to the presence of dielectric material in the electromagnetic field generated by a signal traveling in the transmission line, and further wherein, the phase-shifting slabs within the sub-arrays are arranged such that if the sub-arrays are moved in the same direction, movement of one of the sub-arrays in the direction increases dielectric loading in a first network feed line and movement of the other of the sub-arrays in the direction decreases dielectric loading in a second network feed line.

21. The antenna of claim 20, wherein the phase-shifting slabs within the first sub-array are mechanically linked by a first linkage and driven by a first driving mechanism, and the phase-shifting slabs within the second sub-array are mechanically linked by a second linkage and driven by a second driving mechanism.

22. A steerable phased-array antenna, comprising:

a corporate network feed comprising a feed line that receives a signal and delivers a plurality of signals to a plurality of branch lines;

a plurality of radiating elements that receive the signals from the plurality of branch lines; and a phase-shifter array comprised of a second plurality of phase shifters, each phase shifter operable to affect phase of a signal propagating in one of the branch lines, wherein each successive phase-shifter in the array provides a maximum incremental phase change of $1\Delta\phi$ relative to the previous phase shifter, wherein $\phi$ is given by the expression:

$\phi=2\pi(d/\lambda)\sin\theta_o$, where d is the spacing between radiating elements, $\lambda$ is the wavelength of the transmitted signal and $\theta_o$ is the angle of the main lobe of the radiation pattern generated by a phased-array antenna relative to the normal of the radiating elements; wherein, each phase shifter comprises a phase-shifting slab having:

a phase-shifting member that changes the phase of the signal as the phase-shifting member deviates from a reference position within an electromagnetic field generated by the signal, wherein the phase-shifting member is comprised of a dielectric material; and an impedance-matching member that reduces an impedance step change occurring in a region of transmission line in which the signal propagates due to the presence of the phase-shifting member in the electromagnetic field generated by a signal; wherein, each phase-affected signal is delivered to a different one of the radiating elements.

23. The antenna of claim 22, wherein the impedance-matching member is operable to reduce the impedance step change over substantially a full phase-shifting range of the phase-shifting member.

24. The antenna of claim 23, wherein as the slab deviates from the reference position, there is substantially no change in signal phase due to the impedance-matching member.

25. A phased-array antenna, comprising:

a plurality of radiating elements;

a transmission line for providing a different signal to each radiating element, the transmission line comprising at least one active line and at least one ground spaced therefrom; and a phase shifter for shifting the phase of the signal provided to a radiating element relative to the phase of the signals provided to the other radiating elements, comprising:

a phase-shifting member movable in the space between the active line and the ground, and physically adapted to provide a change in effective dielectric constant as it is moved through the space; and, a first impedance-matching member depending from the phase-shifting member; wherein, the first impedance-matching member reduces impedance mismatch that occurs as the signal travels from a first region of the transmission line having a first impedance to a second region of the transmission line having a second impedance, wherein, in the first region, the phase-shifting member is not present between the active line and the ground, and, in the second region, at least a portion of the phase-shifting member is disposed between the active line and the ground.

* * * * *